US009039162B2

(12) United States Patent
Miller et al.

(10) Patent No.: US 9,039,162 B2
(45) Date of Patent: May 26, 2015

(54) MEDIA MULTI-FEED REJECTION PROCESS WITH AN ENCODED COUNTER-ROTATING ROLLER

(75) Inventors: Gary L. Miller, Vancouver, WA (US); Ed Tucker, Battle Ground, WA (US); Jon Johnson, Vancouver, WA (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 1926 days.

(21) Appl. No.: 11/412,009

(22) Filed: Apr. 25, 2006

(65) Prior Publication Data

US 2007/0247509 A1 Oct. 25, 2007

(51) Int. Cl.

| | |
|---|---|
| ***B41J 2/01*** | (2006.01) |
| ***B41J 23/02*** | (2006.01) |
| ***B65H 3/52*** | (2006.01) |

(52) U.S. Cl.

CPC ..... *B41J 23/025* (2013.01); *B65H 3/5261* (2013.01); *B65H 2403/72* (2013.01); *B65H 2513/40* (2013.01); *B65H 2513/512* (2013.01); *B65H 2553/51* (2013.01)

(58) Field of Classification Search

USPC ..... 347/104, 16, 101; 271/122, 125

See application file for complete search history.

(56) References Cited

U.S. PATENT DOCUMENTS

| | | | | |
|---|---|---|---|---|
| 5,028,043 | A | 7/1991 | Karolyi | |
| 5,449,162 | A * | 9/1995 | Saito et al. | 271/122 |
| 5,647,584 | A * | 7/1997 | Beaudreau et al. | 271/122 |
| 2003/0067108 | A1 * | 4/2003 | Marra et al. | 271/10.01 |
| 2005/0061825 | A1 * | 3/2005 | Willoughby et al. | 221/2 |
| 2005/0184447 | A1 * | 8/2005 | Tsukamoto et al. | 271/109 |
| 2007/0096385 | A1 * | 5/2007 | Mandel et al. | 271/122 |

FOREIGN PATENT DOCUMENTS

| | | | |
|---|---|---|---|
| JP | 6312856 | A | 11/1994 |
| JP | 9020438 | A | 1/1997 |
| JP | 63027368 | A | 2/1998 |
| JP | 2000168983 | | 6/2000 |

* cited by examiner

*Primary Examiner* — Henok Legesse

(74) *Attorney, Agent, or Firm* — Hewlett-Packard Patent Department

(57) ABSTRACT

This invention relates to a media multi-feed rejection apparatus, comprising: a plurality of feed rollers; a feed roller driving means operatively connected to one of the plurality of feed rollers; a clutch means operatively connected to the other of the plurality of feed rollers; and a single channel encoder means operatively connected to the clutch means to measure a rotation of the other of the plurality of feed rollers.

16 Claims, 4 Drawing Sheets

MEDIA MULTI-FEED REJECTION PROCESS WITH AN ENCODED COUNTER-ROTATING ROLLER

BACKGROUND OF THE INVENTION

1. Field of the Invention

This invention relates to a media multi-feed rejection apparatus, comprising: a plurality of feed rollers; a feed roller driving means operatively connected to one of the plurality of feed rollers; a clutch means operatively connected to the other of the plurality of feed rollers; and a single channel encoder means operatively connected to the clutch means to measure a rotation of the other of the plurality of feed rollers.

2. Description of the Related Art

Double feeding of media is not desirable because the printing mechanism will assume that the at least two sheets of media are one sheet of media and print the image across both sheets of media. Also, the double feeding of media may create a media jam in the media handling mechanism. Prior to the present invention, as set forth in general terms above and more specifically below, it is known, in the media handling art to employ a variety of techniques to prevent double feeding of media. Such techniques include various sensors along the media handling path that are used to detect double feeding of media. Also, various mechanisms are utilized to interact with the media in order to prevent double feeding of media. While such systems have met with a modicum of success, none of these systems employ an encoder that monitors the rotation of a counter-rotating roller during the multi-feed rejection process in order to determine the shortest time required to eliminate all excess sheets. Consequently, a more advantageous media double feeding elimination system, then, would be provided if an encoder that monitors the rotation of a counter-rotating roller during the multi-feed rejection process is utilized to determine the shortest time required to eliminate all excess sheets.

It is apparent from the above that there exists a need in the art for a velocity mode encoder that is used to determine the optimum time to stop a multi-feed rejection process on a counter-rotating roller feed system. It is a purpose of this invention to fulfill this and other needs in the art in a manner more apparent to the skilled artisan once given the following disclosure.

SUMMARY OF THE INVENTION

Generally speaking, an embodiment of this invention fulfills these needs by providing a media multi-feed rejection apparatus, comprising: a plurality of feed rollers; a feed roller driving means operatively connected to one of the plurality of feed rollers; a clutch means operatively connected to the other of the plurality of feed rollers; and a single channel encoder means operatively connected to the clutch means to measure a rotation of the other of the plurality of feed rollers.

In certain preferred embodiments, one of the plurality of feed rollers is comprised of a counter-rotating tire. Also, the feed roller driving means is further comprised of a motor. Also, the clutch means is further comprised of slip torque clutch. Also, the clutch means is operatively connected to the feed roller driving means. Finally, the single channel encoder means is further comprised of a velocity mode only encoder.

In another further preferred embodiment, a single channel encoder is used to determine the optimum time to stop a multi-feed rejection process on a counter-rotating roller feed system by monitoring the rotation of a counter-rotating roller during the multi-feed rejection process to determine the shortest time required to eliminate all excess sheets.

The preferred media multi-feed rejection apparatus, according to various embodiments of the present invention, offers the following advantages: ease-of-use; reduced power consumption; reduced power dissipation; reduced noise; reduced mechanical wear; decreased likelihood of media multi-feed; and reduced time to determine the shortest time required to eliminate all excess sheets. In fact, in many of the preferred embodiments, these factors of reduced power consumption, reduced power dissipation, reduced noise, reduced mechanical wear, decreased likelihood of media multi-feed, and reduced time to determine the shortest time required to eliminate all excess sheets are optimized to an extent that is considerably higher than heretofore achieved in prior, known media multi-feed rejection systems.

The above and other features of the present invention, which will become more apparent as the description proceeds, are best understood by considering the following detailed description in conjunction with the accompanying drawings, wherein like characters represent like parts throughout the several views and in which:

DETAILED DESCRIPTION OF THE INVENTION

Figure 1:
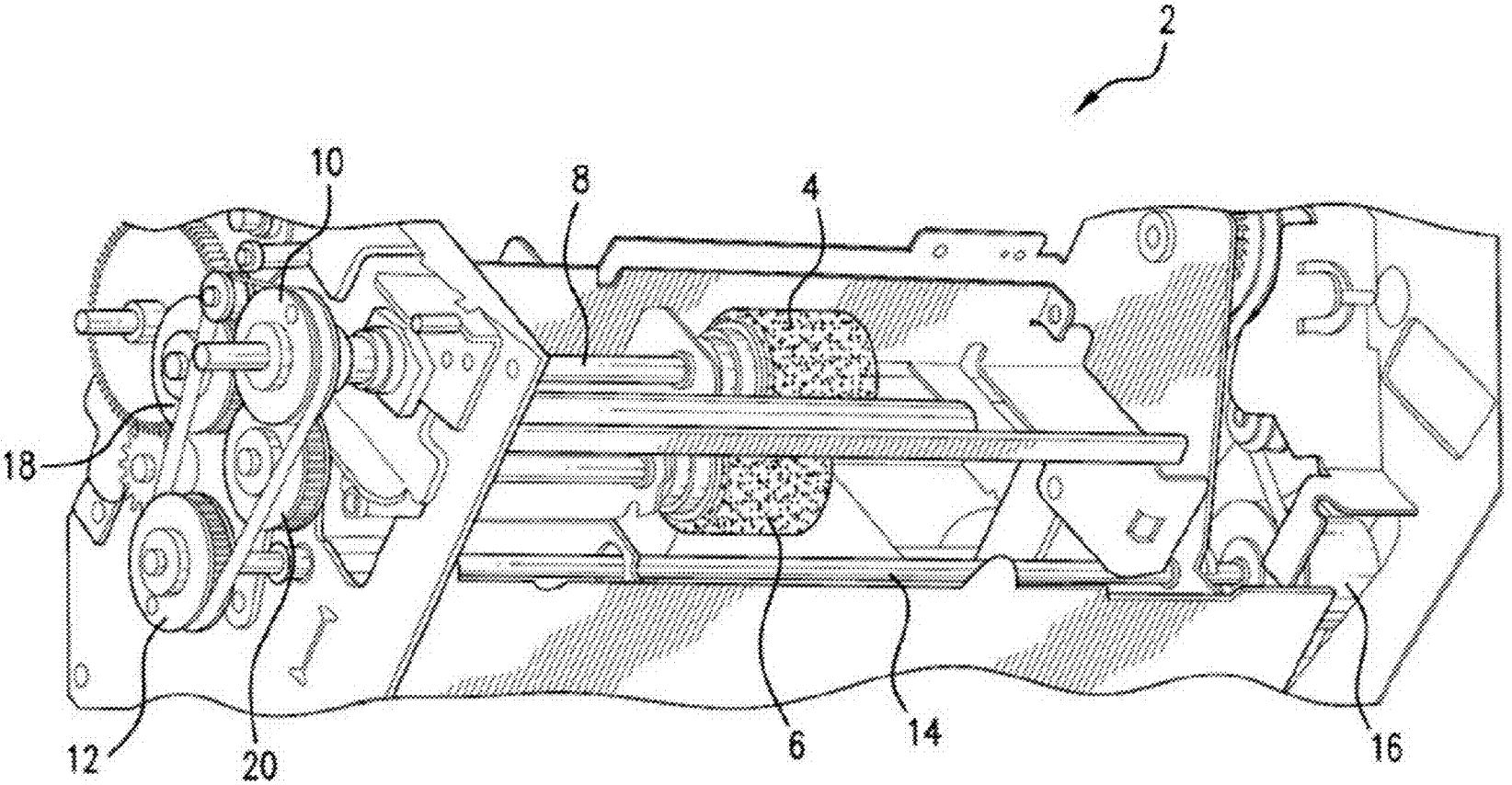
FIG. 1 is a schematic illustration of an optimized multi-feed rejection apparatus, according to one embodiment of the present invention.

With reference first to FIG. 1, there is illustrated one preferred embodiment for use of the concepts of this invention. As shown in FIG. 1, media multi-feed rejection apparatus 2 is illustrated. Apparatus 2 includes, in part, upper feed roller 4, lower feed roller 6, upper feed roller drive shaft 8, upper feed roller drive gear 10, lower drive gear 12, lower drive shaft 14, drive motor 16, and lower feed roller drive gears 18, 20. Lower feed roller 6, preferably, is any suitable counter-rotating feed roller. Drive motor 16, preferably, is any suitable motor that is capable of rotating the various elements of apparatus 2.

With respect to FIG. 1, drive motor 16 is operatively connected to lower drive shaft 14. Lower drive shaft 14 is operatively connected to lower drive gear 12. Lower drive gear 12 is operatively connected to upper feed roller drive gear 10. Upper feed roller drive gear 10 rotates to cause upper feed roller drive shaft 8 and upper feed roller 4 to rotate. Also,. lower drive gear 12 is operatively connected to lower feed roller drive gears 18, 20 to cause lower feed roller 6 to rotate, as will be described below. It is to be understood that upper feed roller 4 and lower feed roller 6 are located with respect to each other so as to feed a sheet of media 100 (FIG. 4) from the media stack towards the printing mechanism (not shown).

Figure 2:
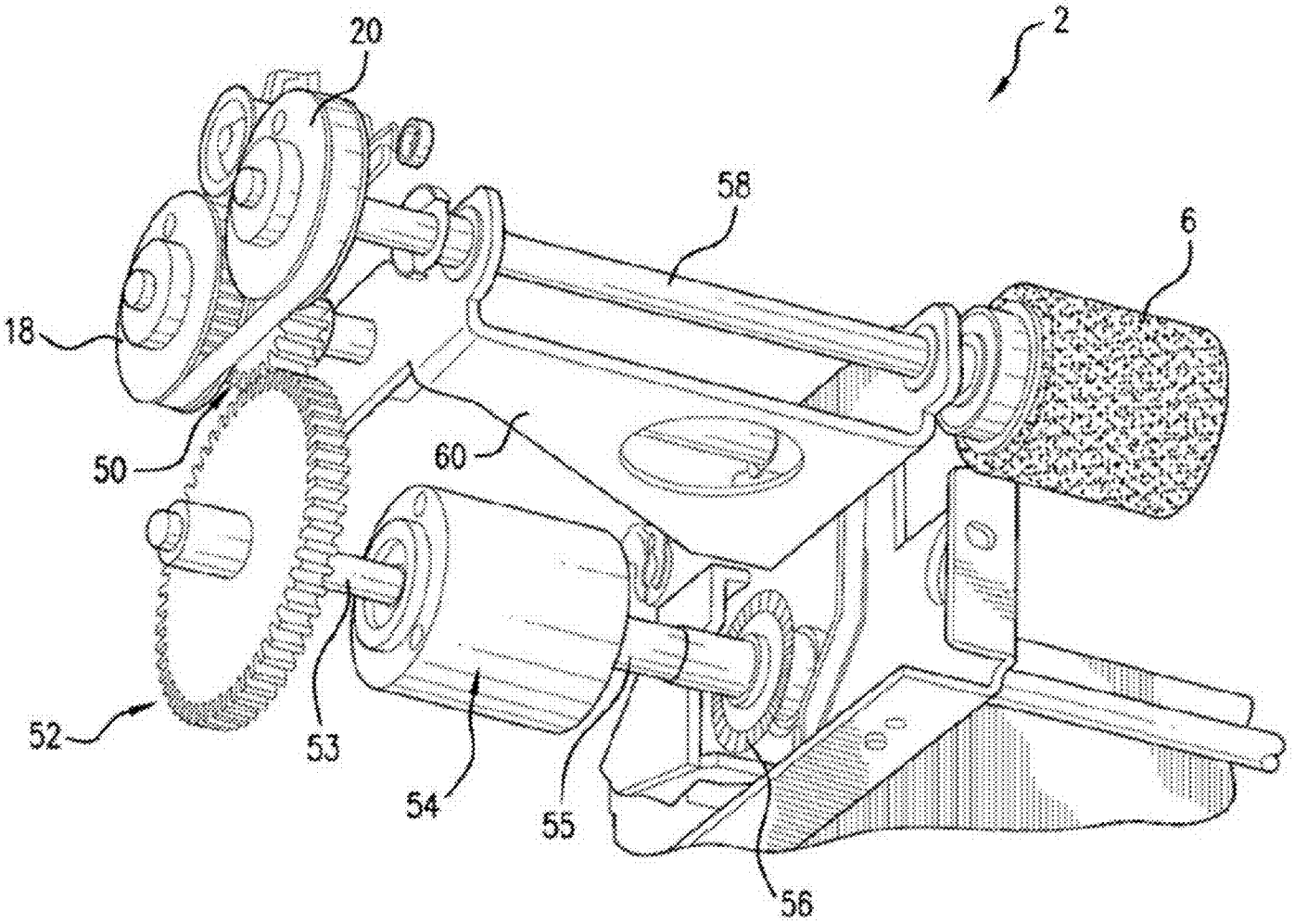
FIG. 2 is a schematic illustration of the optimized multi-feed rejection apparatus with the encoded counter-rotating roller, according to another embodiment of the present invention.

With respect to FIG. 2, apparatus 2 further includes drive gear 50, drive gear 52, drive shaft 53, conventional slip torque clutch 54, drive shaft 55, single channel encoder 56, lower feed roller drive shaft 58, and lower feed roller drive shaft bracket 60. Slip torque clutch 54, preferably, is any suitable clutch that allows lower feed roller 6 to counter-rotate and prevent lower feed roller 6 from rotating in the opposite direction. Also, single channel encoder 56, preferably, is any suitable velocity mode only encoder that is capable of reading any component directly coupled to lower feed roller 6, such as gear teeth or a film or shutter wheel encoder disk.

As shown in FIG. 2, lower drive gear 12 (FIG. 1) is operatively connected to lower feed roller drive gears 18, 20. Drive gear 50 is rotationally connected to lower feed roller drive 18. Drive gear 50 interacts with drive gear 52. Drive gear 52 is rotationally connected to drive shaft 53. Drive shaft 53 interacts with conventional slip torque clutch 54. Conventional slip torque clutch 54 interacts with drive shaft 55. Drive shaft 55 is rotationally connected to single channel encoder 56. Lower feed roller drive gear 18 is operatively connected to lower feed roller drive gear 20. Lower feed roller drive gear 20 is rotationally connected to lower feed roller drive shaft 58. Lower feed roller drive shaft 58 is retained in place by lower feed roller drive shaft bracket 60. Finally, lower feed roller drive shaft 58 is operatively connected to lower feed roller 6.

Figure 3:
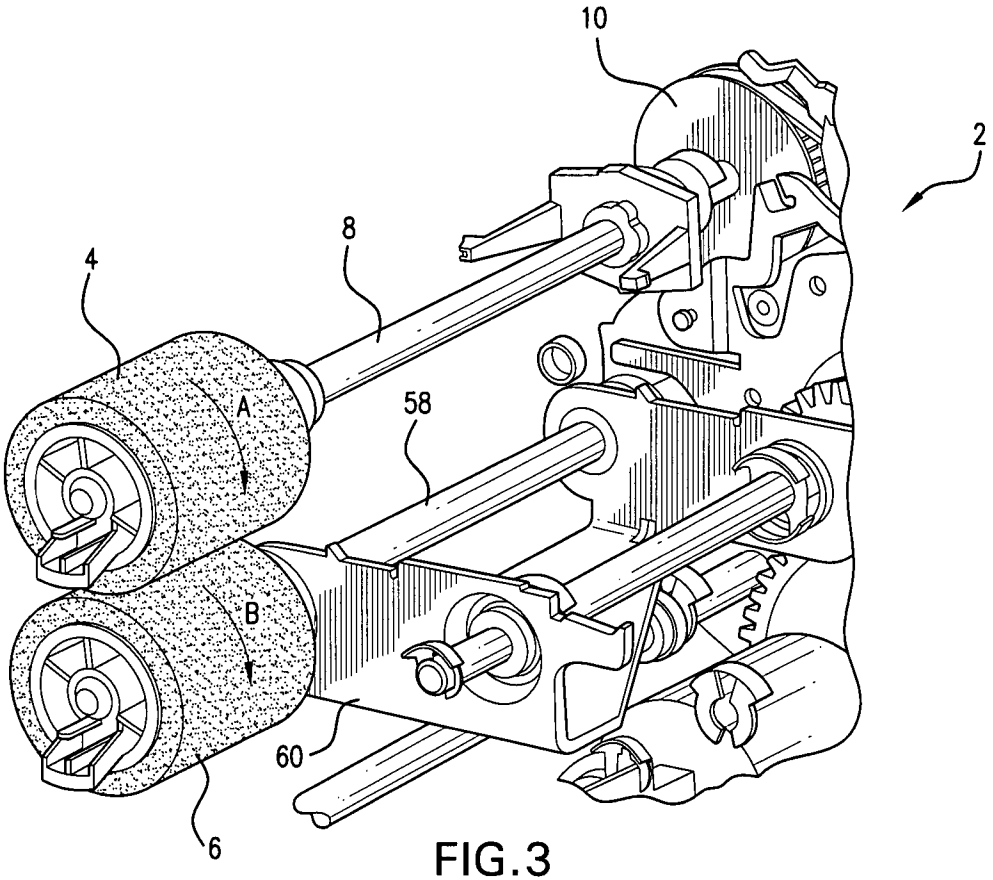
FIG. 3 is another schematic illustration of the optimized multi-feed rejection apparatus, according to another embodiment of the present invention.
Figure 4:
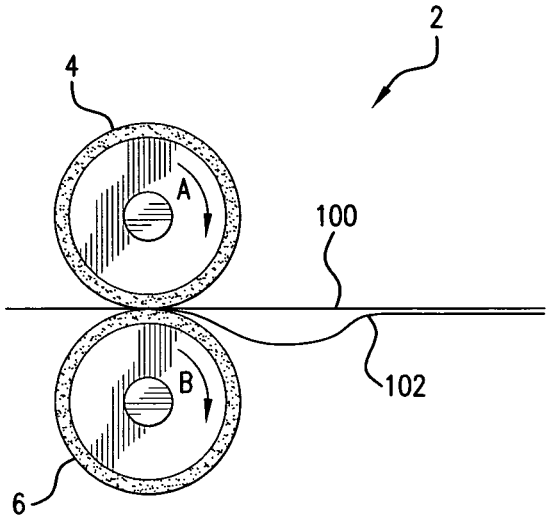
FIG. 4 is a schematic illustration of the optimized multi-feed rejection apparatus, wherein a media multi-feed is prevented, according to another embodiment of the present invention.
Figure 5:
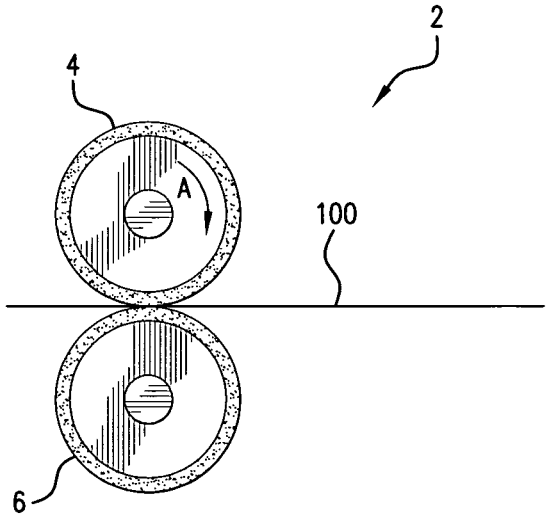
FIG. 5 is a schematic illustration of the optimized multi-feed rejection apparatus, wherein a media multi-feed is not present, according to another embodiment of the present invention.

With respect to FIGS. 3-5, the spaced relationship (nip) between upper feed roller 4 and lower feed roller 6 are more clearly illustrated and will be discussed in more detail below.

With respect to FIGS. 1-5, the operation of multi-feed media rejection apparatus 2 will now be discussed. Drive motor 16 is operated at a constant speed to induce separation between sheets of media 100 and 102 (FIGS. 4 and 5) being pulled off of a stack of media (not shown). Drive motor 16 causes upper feed roller 4 to rotate in the direction of arrow A (FIGS. 3 and 4) to cause the media 100 to be transported from the media stack towards the printing mechanism. At the same time, drive motor 16 drives the input of the slip torque clutch 54 that causes lower feed roller 6 to rotate. In this manner, lower feed roller 6 will rotate only if two or more sheets of media 100 and 102 are present in the nip between upper feed roller 4 and lower feed roller 6 because the staged upper sheet of media 100 (FIG. 4) is stalled by the locked upper feed roller 4 (FIG. 4). If the lower feed roller 6 contacts the stalled upper sheet of media 100, lower feed roller 6 will grip that sheet of media and stop, as well (FIG. 5). It is to be understood that the torque and contact force of the lower feed roller 6 are designed to separate the two sheets of media 100 and 102 (FIG. 4) from each other but grip to any media surface, even if only one sheet of media 100 (FIG. 5) is present. If the lower feed roller 6 contacts the lower sheet of media 102 of a media multi-feed from the stack of media, the counter-rotating nature of lower feed roller 6 along the direction of arrow B (FIGS. 3 and 4) will cause the lower sheet of media 102 to be rejected or otherwise transferred back towards the stack of media and allow only the upper sheet of media 100 to be transported towards the printing mechanism.

As discussed above, during a specific multi-media feed separation sequence, drive motor 16 is operated at a constant speed to induce separation of the multi-media feed. Encoder 56 is conventionally sampled and a velocity of lower feed roller 6 is determined. The velocity of lower feed roller 6 is conventionally compared against a target value. If the velocity of lower feed roller 6 is above the target value, it can be assumed that a multi-media feed separation is being performed and should be allowed to continue. Conversely, if the velocity of lower feed roller 6 is below the target value, it can be assumed that no multi-media feed is present at the nip between upper feed roller 4 and lower feed roller 6. It is to be understood that a maximum time limit may be imposed on how long the velocity of lower feed roller 6 can be maintained above the target value. If the maximum time limit is exceeded, multi-feed media rejection apparatus 2 is checked/observed to determine if excessive slippage is occurring at the nip between upper feed roller 4 and lower feed roller 6.

It is to be understood that the present invention can be embodied in any computer-readable medium for use by or in connection with an instruction-execution system, apparatus or device such as a computer/processor based system, processor-containing system or other system that can fetch the instructions from the instruction-execution system, apparatus or device, and execute the instructions contained therein. In the context of this disclosure, a "computer-readable medium" can be any means that can store a program for use by or in connection with the instruction-execution system, apparatus or device. The computer-readable medium can comprise any one of many physical media such as, for example, electronic, magnetic, or semiconductor media. More specific examples of a suitable computer-readable medium would include, but are not limited to, a portable magnetic computer diskette such as floppy diskettes or hard drives, a random access memory (RAM), a read-only memory (ROM), an erasable programmable read-only memory, or a portable compact disc. It is to be understood that the computer-readable medium could even be paper or another suitable medium upon which the program is printed, as the program can be electronically captured, via, for instance, optical scanning of the paper or other medium, then compiled, interpreted or otherwise processed in a single manner, if necessary, and then stored in a computer memory.

Those skilled in the art will understand that various embodiment of the present invention can be implemented in hardware, software, firmware or combinations thereof. Separate embodiments of the present invention can be implemented using a combination of hardware and software or firmware that is stored in memory and executed by a suitable instruction-execution system. If implemented solely in hardware, as in an alternative embodiment, the present invention can be separately implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In preferred embodiments, the present invention can be implemented in a combination of software and data executed and stored under the control of a computing device.

It will be well understood by one having ordinary skill in the art, after having become familiar with the teachings of the present invention, that software applications may be written in a number of programming languages now known or later developed.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A method, comprising:

rotating a first feed roller in a first rotational direction to cause sheets of media to move towards a printing mechanism;

rotating a second feed roller in the first rotational direction to cause surfaces of the first feed roller and the second feed roller to rotate in opposite directions in a nip between the first and second feed roller;

preventing the second feed roller from rotating in a second rotational direction opposite the first rotational direction while sheets of media are being fed into the nip;

ascertaining rotational velocity of the second feed roller in the first rotational direction; and determining that a multi-feed separation is being performed in response to a determination that the ascertained rotational velocity of the second feed roller in the first rotational direction exceeds a threshold value.

2. The method as in claim 1, further comprising:

contacting the second feed roller with a lower sheet of media in a media multi-feed such that the rotation of the second feed roller causes the lower sheet of media to be rejected.

3. The method as in claim 2, wherein the contacting further comprises:

changing the rotational velocity of the second feed roller in the first rotational direction to a level that is above a target velocity.

4. The method as in claim 1, further comprising:

determining the threshold value.

5. The method as in claim 1, wherein the ascertaining further comprises:

utilizing a single channel encoder to determine the ascertained rotational velocity of the second feed roller.

6. The method as in claim 1, wherein the ascertaining further comprises:

ceasing rotation of the second feed roller in response to contact of the second feed roller with only one sheet of media.

7. The method as in claim 6, wherein the contacting further comprises:

changing velocity of the second feed roller to a level that is below a target velocity.

8. The method as in claim 1, further comprising:

imposing a maximum time limit on how long the ascertained rotational velocity of the second feed roller can be maintained above the threshold value.

9. A non-transitory computer-readable medium tangibly embodying instructions that, when executed by the computer cause the computer to perform a method comprising:

rotating a first feed roller in a first rotational direction to cause sheets of media to move towards a printing mechanism;

rotating a second feed roller in the first rotational direction to cause surfaces of the first feed roller and the second feed roller to rotate in opposite directions in a nip between the first and second feed roller;

preventing the second feed roller from rotating in a second rotational direction opposite the first rotational direction while sheets of media are being fed into the nip;

ascertaining rotational velocity of the second feed roller in the first rotational direction; and determining that a multi-feed separation is being performed in response to a determination that the ascertained rotational velocity of the second feed roller in the first rotational direction exceeds a threshold.

10. The non-transitory computer-readable medium as in claim 9, wherein the method further comprises:

contacting the second feed roller with a lower sheet of media in a media multi-feed such that the rotation of the second feed roller causes the lower sheet of media to be rejected.

11. The non-transitory computer-readable medium as in claim 10, wherein the contacting comprises:

changing velocity of the second feed roller in the first rotational direction to a level that is above a target velocity.

12. The non-transitory method as in claim 9, wherein method further comprises:

determining the threshold value.

13. The non-transitory computer-readable medium as in claim 9, wherein the ascertaining comprises:

utilizing a single channel encoder to determine the ascertained rotational velocity of the second feed roller.

14. The non-transitory computer-readable medium as in claim 9, wherein the ascertaining comprises:

ceasing rotation of the second feed roller in response to contact of the second feed roller with only one sheet of media.

15. The non-transitory computer-readable medium as in claim 14, wherein the contacting comprises:

changing velocity of the second feed roller in the first rotational direction to a level that is below a target velocity.

16. The non-transitory computer-readable medium as in claim 9, wherein the method further comprises;

imposing a maximum time limit on how long the ascertained rotational velocity of the second feed roller can be maintained above the threshold value.

* * * * *